US006119881A

United States Patent [19]

Yang

[11] Patent Number: 6,119,881

[45] Date of Patent: Sep. 19, 2000

[54] ASSEMBLY FOR FASTENING HORIZONTAL SUPPORT FRAMES TO UPRIGHT SUPPORTS OF A RACK

[76] Inventor: Hsin Chen Yang, No. 423, Dou-Yuan Rd., Sec. 2, Bei-Dou Township, Changhua County, Taiwan

[21] Appl. No.: 09/123,397

[22] Filed: Jul. 28, 1998

[51] Int. Cl.[7] ..... A47B 43/00

[52] U.S. Cl. ..... 211/189; 108/147.13

[58] Field of Search ..... 108/147.11, 147.12, 108/147.13, 147.15; 211/181.1, 182, 187, 189

[56] References Cited

U.S. PATENT DOCUMENTS

| | | | |
|---|---|---|---|
| 2,649,972 | 8/1953 | Weil | 108/147.11 |
| 2,894,643 | 7/1959 | Maslow | 211/189 |
| 2,919,816 | 1/1960 | Maslow | 211/182 |
| 2,970,702 | 2/1961 | Maslow | 211/189 |
| 3,208,406 | 9/1965 | Maslow | 108/147.11 |
| 3,280,767 | 10/1966 | Kahn | 108/147.13 |
| 3,332,374 | 7/1967 | Ferdinand et al. | 108/147.11 |
| 3,589,746 | 6/1971 | Inglis | 108/147.11 |
| 3,604,369 | 9/1971 | Maslow | 108/144.11 |
| 3,883,104 | 5/1975 | Delafield | 108/147.11 X |
| 4,079,678 | 3/1978 | Champagne | 108/144.11 |
| 4,595,107 | 6/1986 | Welsch | 211/187 |
| 4,896,778 | 1/1990 | Ferdinand et al. | 211/189 |
| 5,244,104 | 9/1993 | Green et al. | 211/181.1 |
| 5,303,645 | 4/1994 | Meacham | 108/147.11 X |
| 5,326,062 | 7/1994 | Remmers | 211/181.1 |
| 5,833,084 | 11/1998 | Chang | 211/187 |

*Primary Examiner*—Daniel P. Stodola
*Assistant Examiner*—Jennifer E. Novosad
*Attorney, Agent, or Firm*—Bacon & Thomas, PLLC

[57] ABSTRACT

A rack is formed of four upright support units and a plurality of horizontal support frames. Each of the horizontal support frames is provided at four corners thereof with a fastening plate which is provided with a threaded hole engageable with a fastening bolt. The horizontal support frames are fastened with the upright support units by a plurality of fastening blocks which are provided with a threaded hole engageable with the fastening bolt, and a retaining portion for retaining an upright bar of the upright support units.

1 Claim, 11 Drawing Sheets

ASSEMBLY FOR FASTENING HORIZONTAL SUPPORT FRAMES TO UPRIGHT SUPPORTS OF A RACK

FIELD OF THE INVENTION

The present invention relates generally to a rack, and more particularly to a component assembly of the rack.

BACKGROUND OF THE INVENTION

As shown in FIGS. 1 and 2, a prior art rack is composed of four upright support units, a plurality of horizontal support frames, and a plurality of fastening blocks for fastening the horizontal support frames with the four upright support units. Each of the horizontal support frames has four corners which are respectively fastened with a fastening block by welding. The fastening block has a retaining portion of a semicircular cross section for retaining an upright support unit. Each of the four upright support units is formed of two upright rods parallel to each other.

Such a prior art rack as described above is defective in design in that the horizontal support frames are incapable of carrying the weight of a heavy article placed thereon in light of the horizontal support frames being fastened with the fastening blocks by welding. In addition, the prior art rack cannot be easily assembled by a do-it-yourselfer.

SUMMARY OF THE INVENTION

The primary objective of the present invention is therefore to provide an improved rack free from the structural drawbacks of the prior art rack described above.

In keeping with the principle of the present invention, the foregoing objective of the present invention is attained by a rack consisting of four upright support units, a plurality of horizontal support frames, and a plurality of fastening blocks for fastening the horizontal support frames with the four upright support units. Each of the horizontal support frames is provided respectively at four corners thereof with a fastening plate fastened therewith. The fastening plate is provided with a threaded hole engagable with a fastening bolt. The fastening blocks are respectively provided with a threaded hole engageable with the fastening bolt. The horizontal support frames are thus fastened with the four upright support units by a plurality of fastening blocks, fastening plates, and fastening bolts which are engaged with the threaded holes of the fastening blocks and the fastening plates.

The foregoing objective, features, functions, and advantages of the present invention will be more readily understood upon a thoughtful deliberation of the following detailed description of the embodiments of the present invention with reference to the accompanying drawings.

DETAILED DESCRIPTION OF THE EMBODIMENTS

Figure 1:
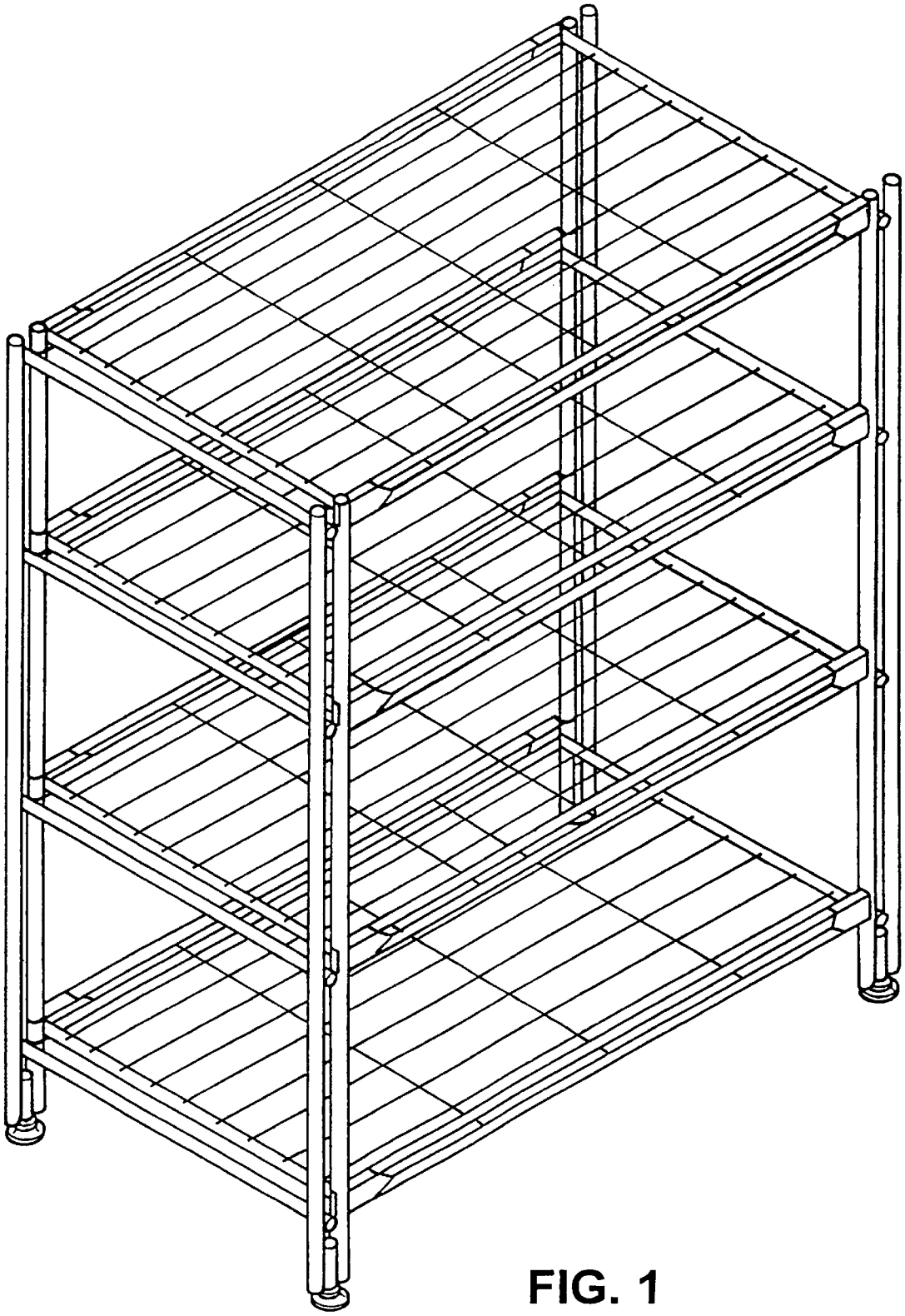
FIG. 1 PRIOR ART
FIG. 1 shows a perspective view of a rack of the prior art.
Figure 1A:
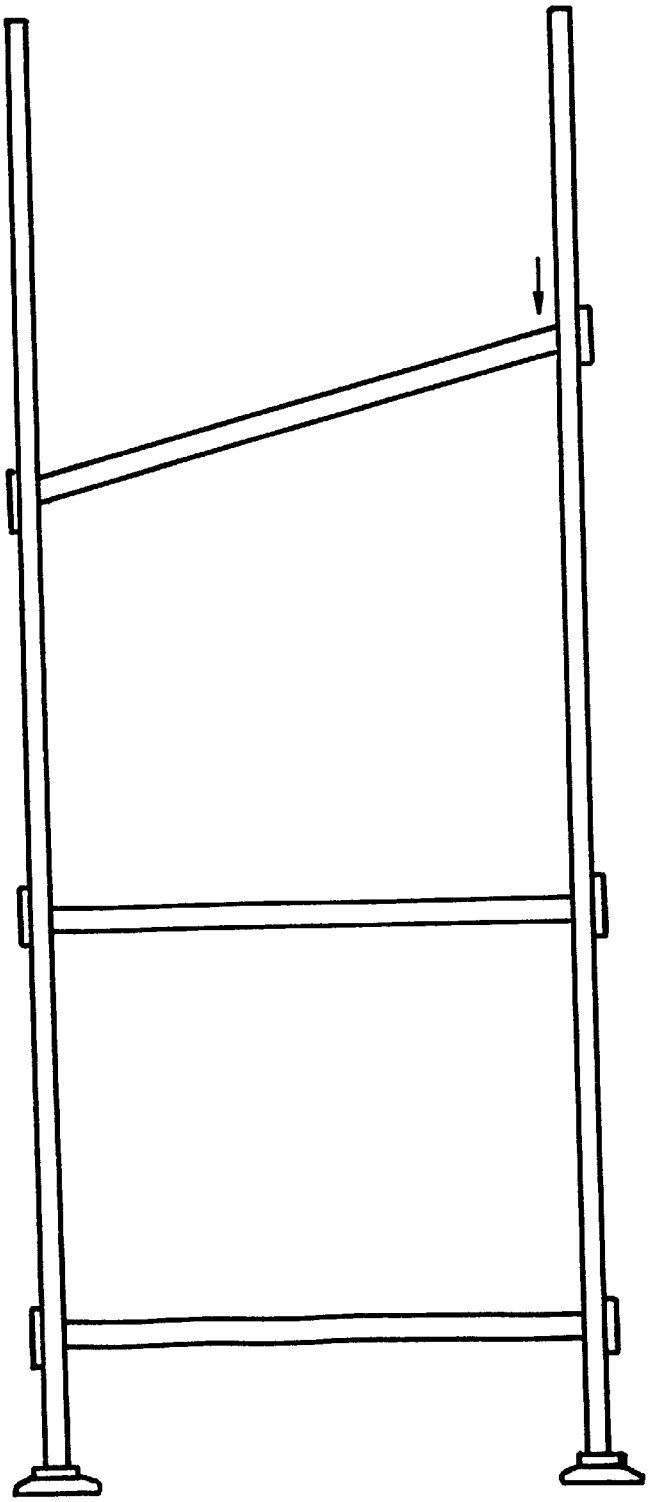
FIG. 1 A PRIOR ART
FIG. 1A shows a side schematic view of the rack of the prior art.
Figure 2:
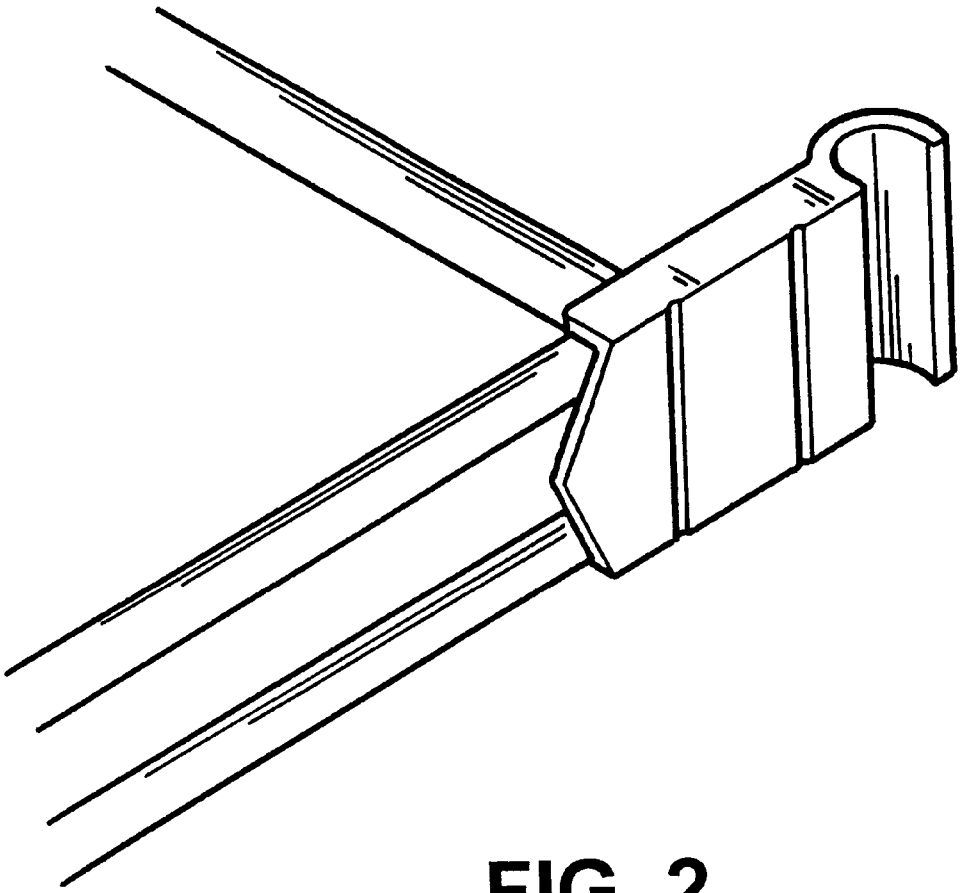
FIG. 2 PRIOR ART
FIG. 2 shows a partial schematic view of a horizontal support frame which is fastened with a fastening block of the rack as shown in FIG. 1.
Figure 3:
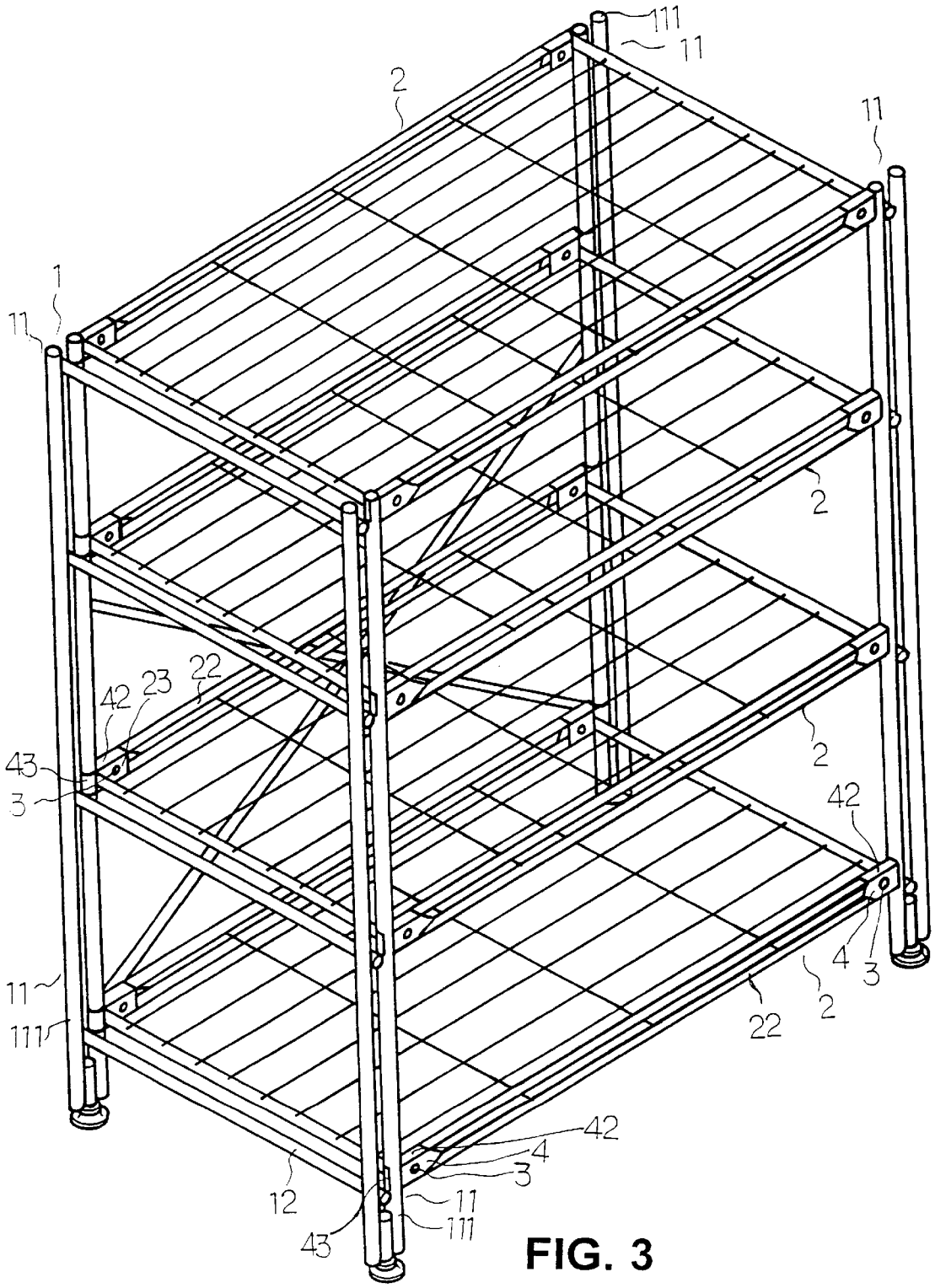
FIG. 3 shows a schematic perspective view of a rack of the present invention.
Figure 4:
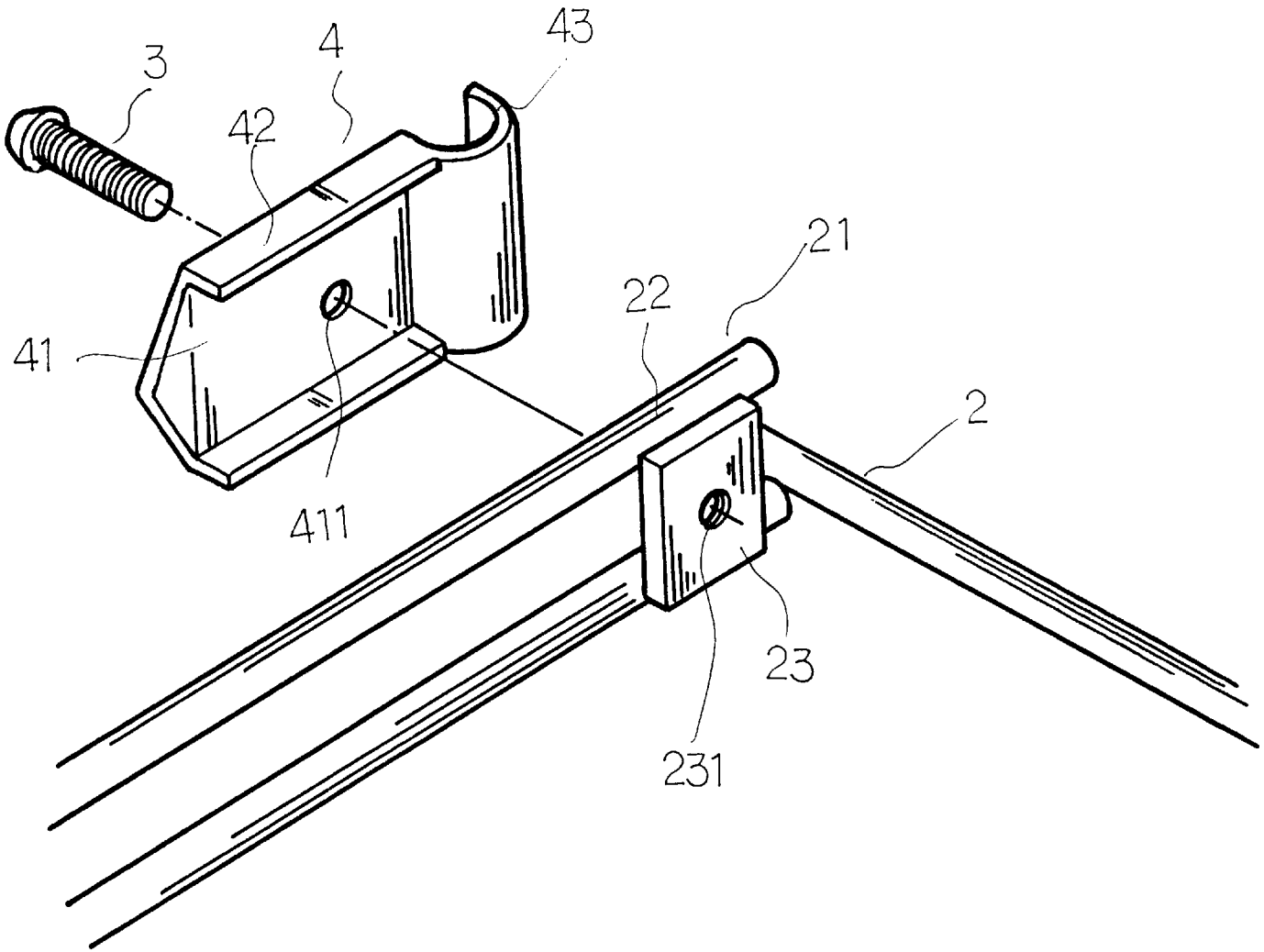
FIG. 4 shows a partial exploded view of the assembly of a fastening block and a horizontal support frame of the present invention.
Figure 4A:
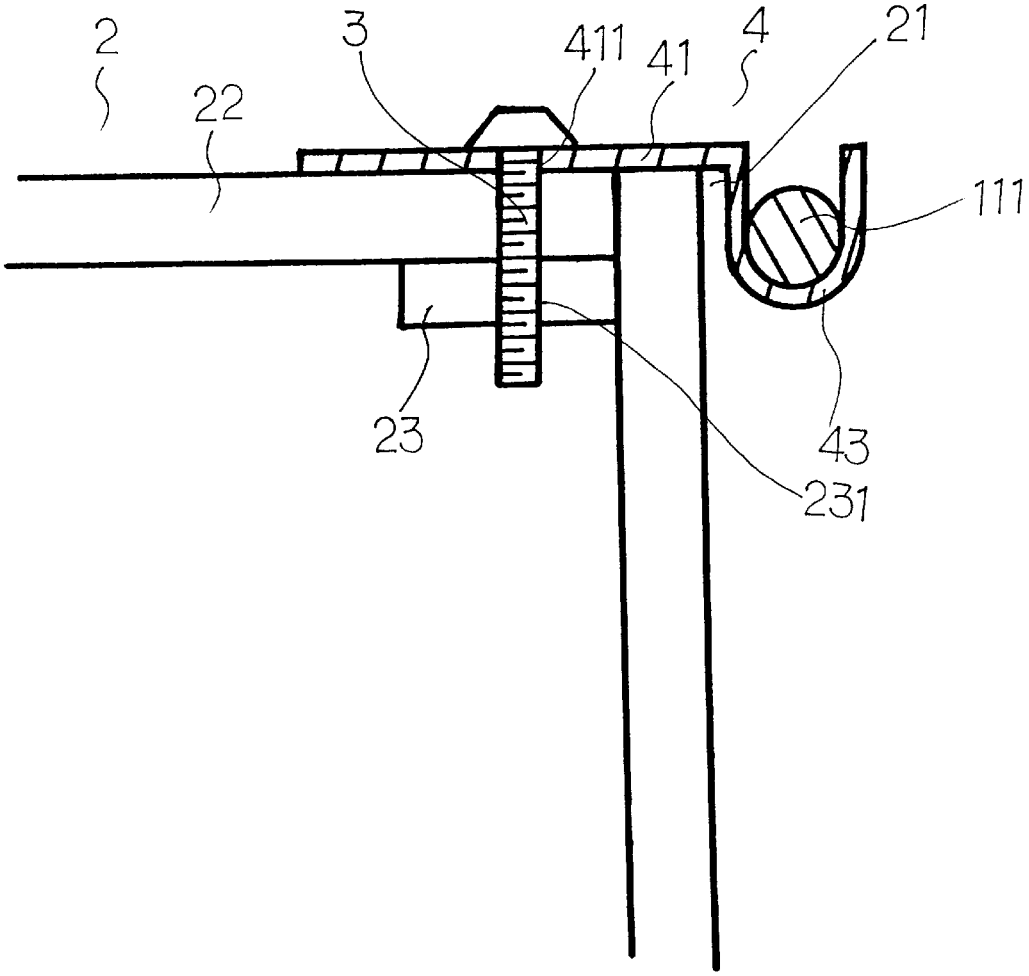
FIG. 4A shows a sectional schematic view of the engagement of the fastening block with the horizontal support frame of the present invention as shown in FIG. 4.
Figure 4B:
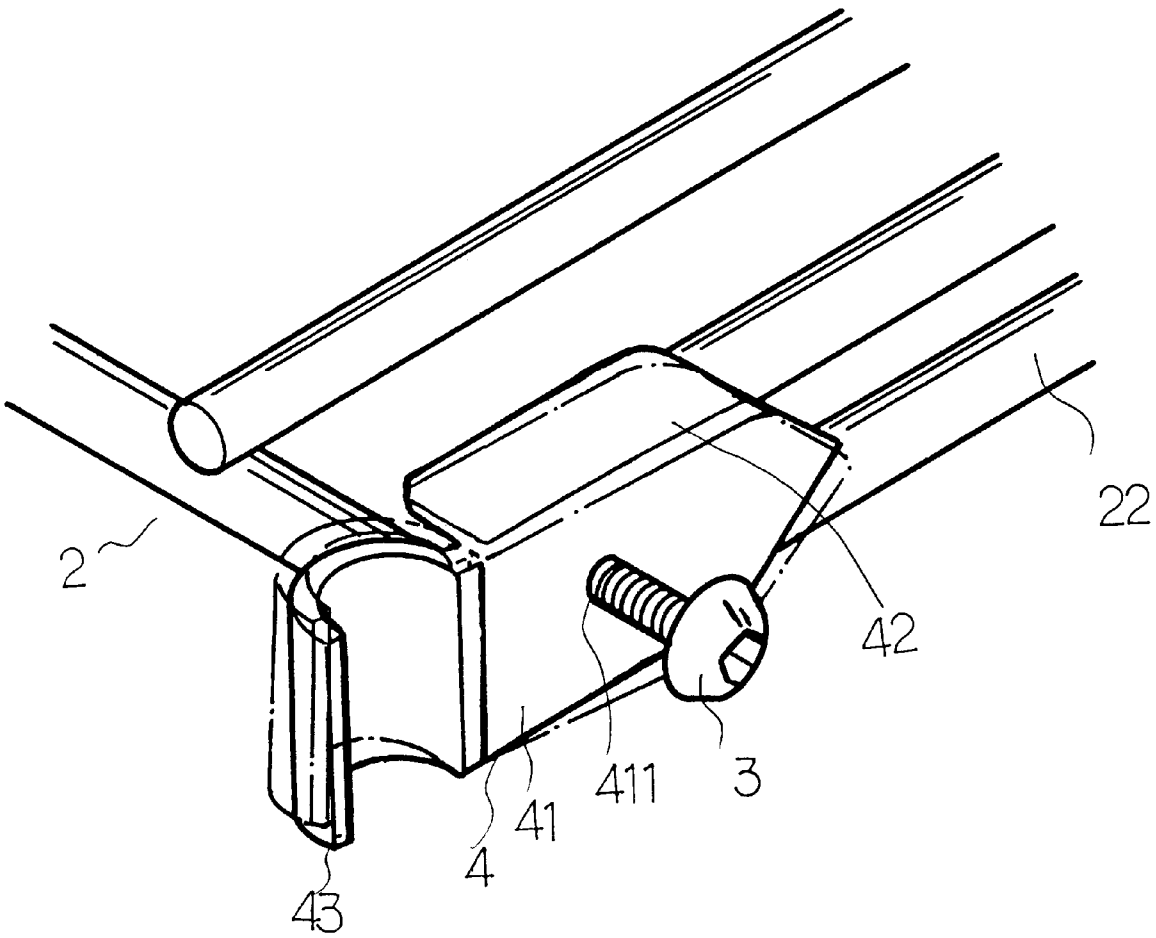
FIG. 4B shows a schematic view of the assembly of the fastening block of present invention as shown in FIG. 4.

As shown in FIGS. 3–4B, a rack 1 embodied in the present invention is composed of a plurality of horizontal support frames 2, four upright support units 11, a plurality of fastening bolts 3 and fastening blocks 4.

Each of the horizontal support frames 2 is made of a plurality of metal bars and metal wires and has two longitudinal sides opposite to each other. Each horizontal support frame 2 has four corners 21 which are respectively provided with a fastening plate 23 which is fastened between two metal frame bars 22 of the longitudinal side of the horizontal support frame 2, as shown in FIG. 4. The fastening plate 23 is provided at the center thereof with a threaded hole 231 engageable with the fastening bolts 3. Each of the fastening blocks 4 has a main body 41, two upright walls 42 opposite to each other, and a retaining portion 43 of having a semicircular cross section and extending from one end of the main body 41. The main body 41 is provided with a threaded hole 411 corresponding in location to the threaded hole 231 of the fastening plate 23 and engageable with the fastening bolts 3. Each corner 21 of the horizontal support frame 2 is fastened with the fastening block 4 by the fastening bolts 3 which are engaged with the threaded hole 231 of the fastening plate 23 and the threaded hole 411 of the fastening block 4. In the meantime, the two metal frame bars 22 are confined by the two upright walls 42 of the fastening block 4.

Figure 3A:
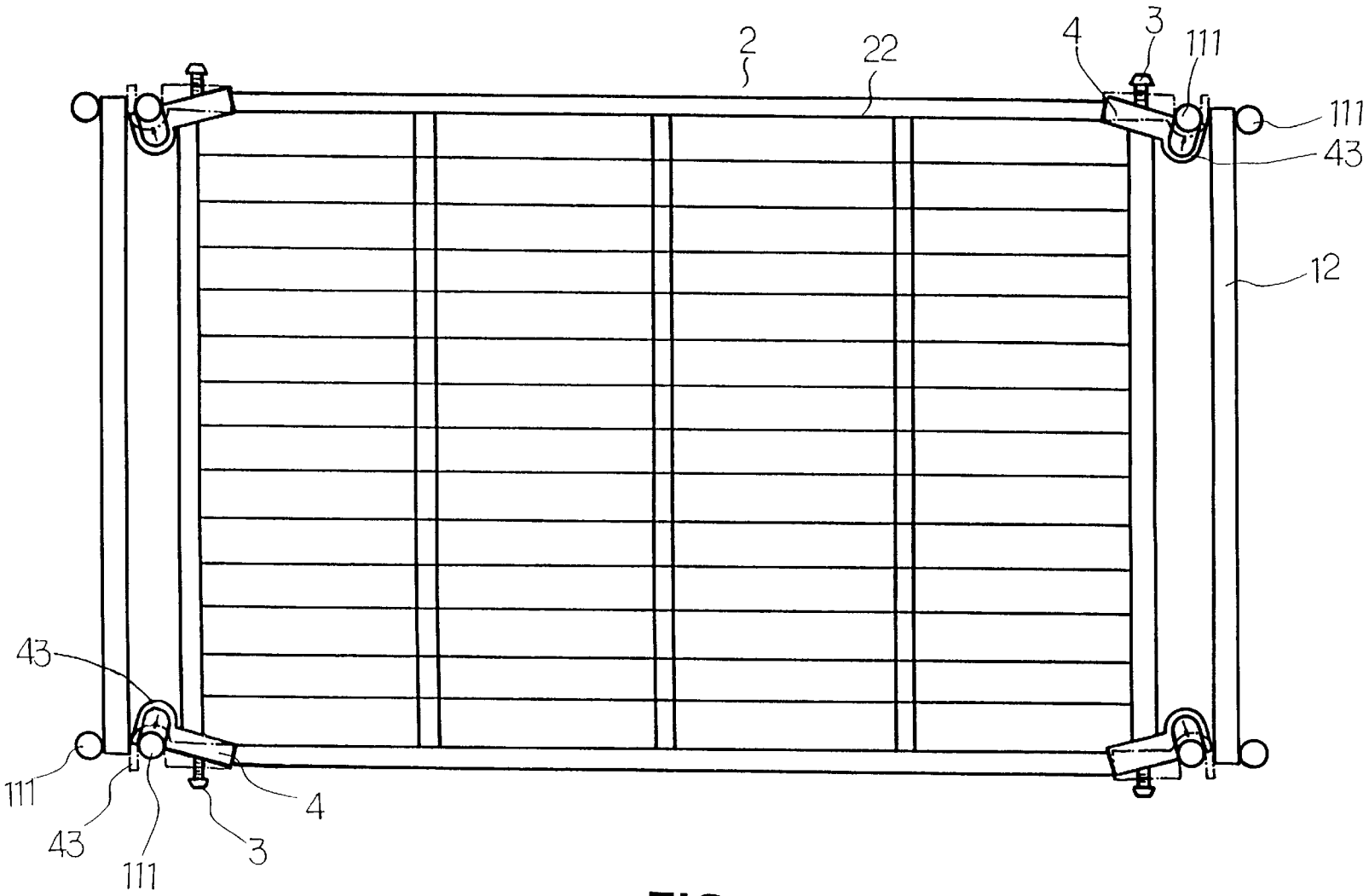
FIG. 3A shows a schematic view of the assembly of a horizontal support frame of the rack of the present invention as shown in FIG. 3.

Each of the four upright support units 11 is formed of two upright metal bars 111 parallel to each other, and a plurality of metal cross rods 12 which are located between the two upright metal bars 111 such that the metal cross rods 12 are corresponding in location to the horizontal support frames 2. One of the two upright metal bars 111 is dimensioned to be retained by the retaining portion 43 of the fastening block 4, as shown in FIG. 3A.

It is therefore readily apparent that the rack 1 of the present can be easily assembled and disassembled by a do-it-yourselfer. The horizontal support frames 2 can be easily fastened with the upright support units 11 by fastening the bolts 3. In the meantime, the horizontal support frames 2 can be easily separated from the upright support units 11 by unfastening the bolts 3.

Figure 5:
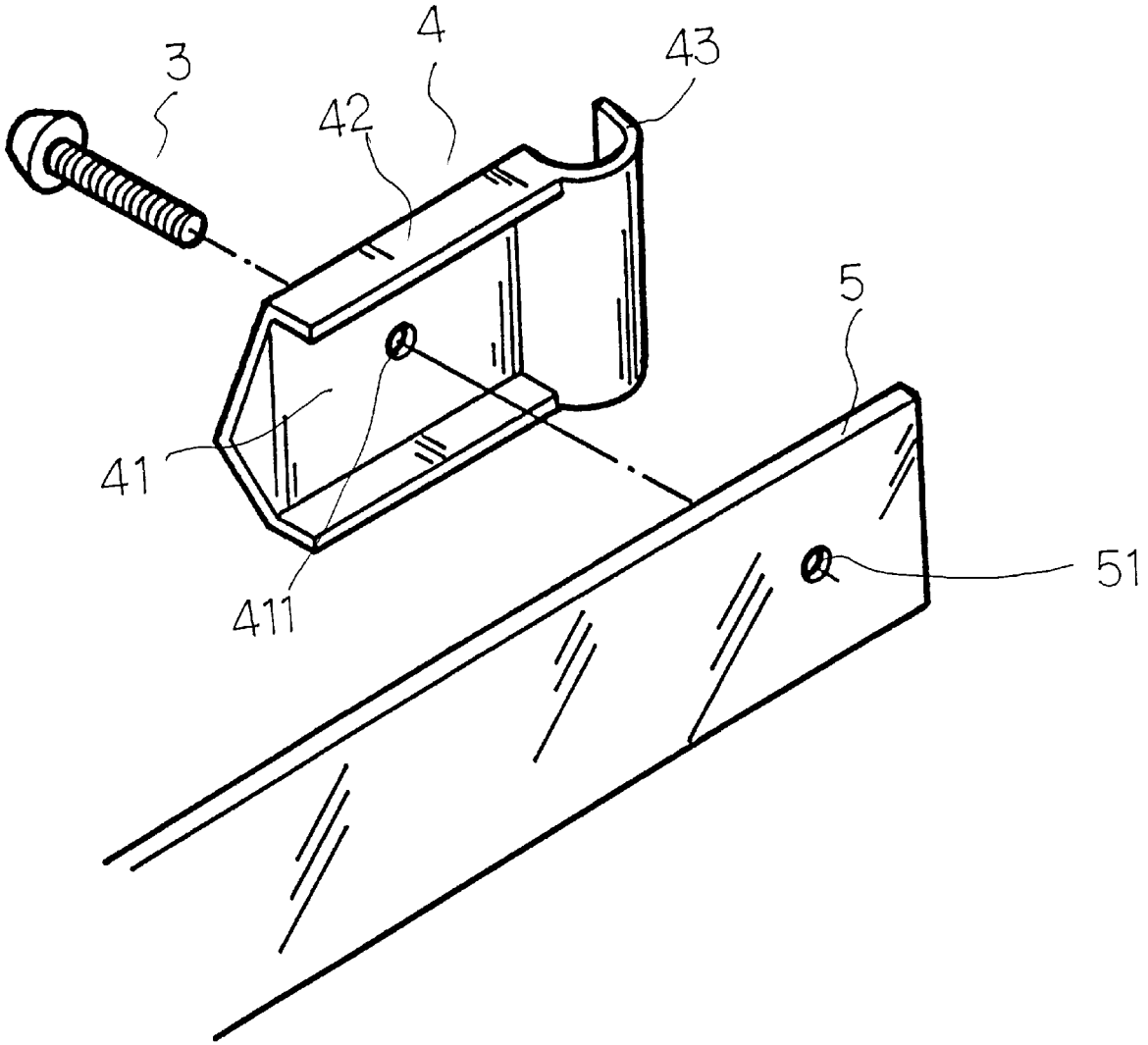
FIG. 5 shows a partial exploded view of the assembly of a fastening block and a horizontal support frame of another embodiment of the present invention.
Figure 6:
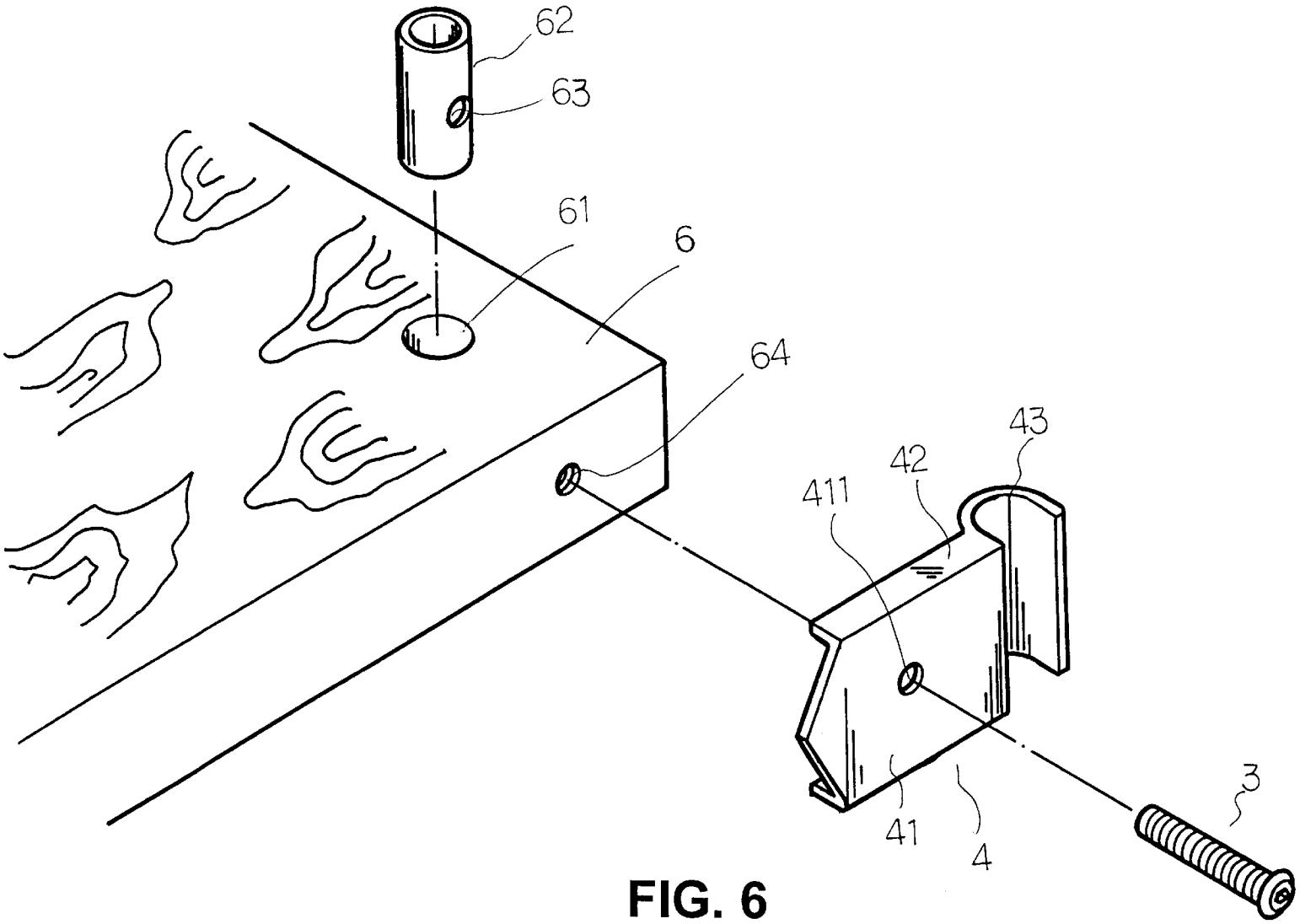
FIG. 6 shows a partial exploded view of the assembly of a fastening block and a horizontal support frame of still another embodiment of the present invention.
Figure 6A:
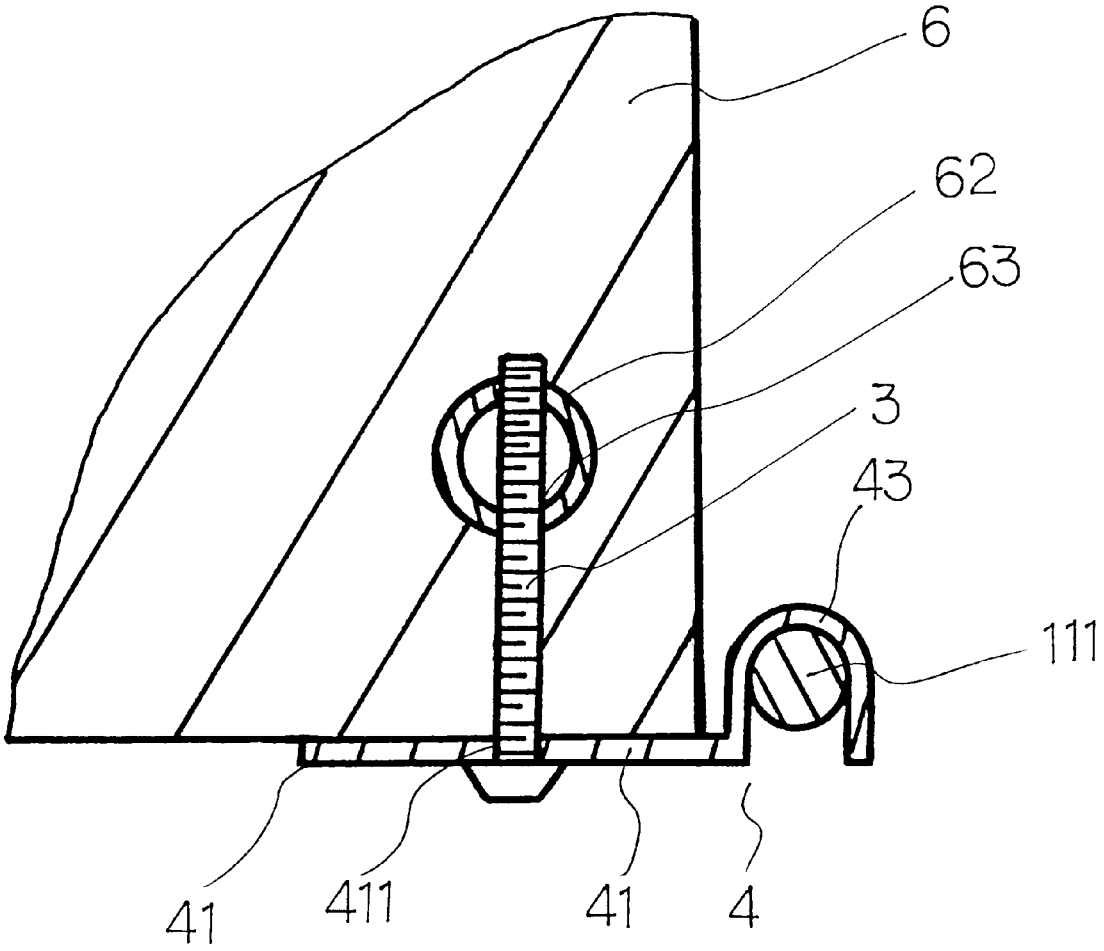
FIG. 6A shows a sectional schematic view of the engagement of the fastening block with the horizontal support frame of the present invention as shown in FIG. 6.

The embodiment of the present invention described above is to be deemed in all respects as being merely illustrative and not restrictive. Accordingly, the present invention may be embodied in other specific forms without deviating from the spirit thereof. For example, the horizontal support frames 2 of the present invention may be provided with an elongated plate body 5 in place of the two frame bars 22, and the fastening plate 23, as shown in FIG. 5. The plate body 5 is provided with a threaded hole 51 corresponding in location to the threaded hole 411 of the fastening plate 4 and engageable with the fastening bolts 3. In addition, the rack 1 of the present invention may be composed of a plurality of wooden boards 6 in place of the metal horizontal support frames 2, as shown in FIG. 6. The wooden boards 6 have a predetermined thickness and are provided in the longitudinal side wall thereof with a threaded hole 64 corresponding in location to the threaded hole 411 of the fastening block 4 and engageable with the fastening bolt 3. The wooden boards 6 are further provided respectively at four corners with a locating hole 61 perpendicular to the threaded hole 64. The locating hole 61 is intended to locate a locating tube 62. Locating tube is provided in the side wall thereof with a threaded through hole 63. Threaded through hole 63 which is in alignment with the threaded holes 64 and 411, and is engageable with the fastening bolt 3. The fastening block 4 is thus fastened securely with the wooden board 6 by the fastening bolt 3, thanks to the locating tube 62. The present invention is therefore to be limited only by the scopes of the following appended claims.

What is claimed is:

1. A rack comprising:

four upright support units each consisting of two upright bars parallel to each other; and a plurality of horizontal support frames each having four corners, said horizontal support frames being fastened respectively at said four corners thereof with said upright support units, each of said horizontal support frames having two longitudinal sides, and each of said two longitudinal sides having two ends, the two ends of one of the two longitudinal sides extending between a first two of said four corners, and the two ends of a second of the two longitudinal sides extending between a second two of said four corners;

wherein said four ends are respectively provided with a fastening plate fastened therewith, said fastening plate provided with a threaded hole;

wherein said four corners are respectively provided with a fastening block having a threaded hole and a retaining portion for retaining one of said two upright bars of each of said four upright support units, each said fastening block being fastened with one of said four ends by a fastening bolt which engages said threaded hole of said fastening block and said threaded hole of said fastening plate, wherein said horizontal support frames are made of a wooden board having a thickness, said wooden board having two longitudinal side walls which are provided respectively at both longitudinal ends thereof with a threaded hole; and wherein said fastening block is fastened with one of said longitudinal ends of said longitudinal side wall of said wooden board by said fastening bolt which engages said threaded hole of said fastening block and said threaded hole of said wooden board, and wherein said wooden board has four corners which are provided respectively with a locating hole perpendicular to said threaded hole of said longitudinal side wall of said wooden board, and a locating tube which is provided in a side wall thereof with a threaded hole and is received in said locating hole such that said threaded hole of said locating tube engages said fastening bolt which engages said threaded hole of said fastening block.

* * * * *